US009761100B2

(12) United States Patent
Anson et al.

(10) Patent No.: US 9,761,100 B2
(45) **Date of Patent: *Sep. 12, 2017**

(54) ANTI-LOSS FOR MEDICAL DEVICES

(71) Applicant: Welch Allyn, Inc., Skaneateles Falls, NY (US)

(72) Inventors: Michael J. Anson, Jordan, NY (US); Zhon Chu, Syracuse, NY (US); Jennifer Grant, Syracuse, NY (US); Matthew D. Mullin, Memphis, NY (US); David E. Quinn, Auburn, NY (US); Alisa R. Salibra, Fayetteville, NY (US)

(73) Assignee: Welch Allyn, Inc., Skaneateles Falls, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/048,499

(22) Filed: Feb. 19, 2016

(65) Prior Publication Data

US 2016/0171851 A1 Jun. 16, 2016

Related U.S. Application Data

(63) Continuation of application No. 14/189,378, filed on Feb. 25, 2014, now Pat. No. 9,299,240.
(Continued)

(51) Int. Cl.
*G08B 13/14* (2006.01)
*G08B 21/24* (2006.01)
*G08B 21/02* (2006.01)

(52) U.S. Cl.
CPC ..... *G08B 13/1427* (2013.01); *G08B 21/24* (2013.01); *G08B 21/0277* (2013.01)

(58) Field of Classification Search
CPC . A61B 5/0008; A61B 5/01; A61B 2010/0019; A61B 2562/164; A61B 5/0002; A61B 5/0022; G01K 1/024; G01K 13/002; G01K 15/00; G08B 13/1427; G01J 5/0265; G08C 17/02; H02K 11/35
See application file for complete search history.

(56) References Cited

U.S. PATENT DOCUMENTS 4,658,818 A 4/1987 Miller, Jr. et al.
4,709,330 A 11/1987 Yokoi et al.
(Continued)

FOREIGN PATENT DOCUMENTS

CA 2331702 A1 9/2000
EP 1 965 691 B1 6/2011
(Continued)

OTHER PUBLICATIONS

International Search Report and Written Opinion in PCT/US2011/06119 mailed May 18, 2012, 8 pages.
(Continued)

*Primary Examiner* — Fekadeselassie Girma
(74) *Attorney, Agent, or Firm* — Merchant & Gould P.C.

(57) ABSTRACT

A medical device system includes one or more anti-loss/anti-theft mechanisms. The medical device system comprises a wireless medical device and a docking station. An alarm is activated on one or more of the wireless medical device or the docking station when an alarm threshold is detected by one of the anti-loss/anti-theft mechanisms.

16 Claims, 12 Drawing Sheets

Related U.S. Application Data

(60) Provisional application No. 61/769,824, filed on Feb. 27, 2013.

(56) References Cited

U.S. PATENT DOCUMENTS 4,790,324 A 12/1988 O'Hara et al.
5,197,487 A 3/1993 Ackerman et al.
5,494,046 A 2/1996 Cross
5,518,002 A 5/1996 Wolf et al.
5,751,214 A 5/1998 Cowley
5,801,627 A 9/1998 Hartung
5,844,862 A 12/1998 Cocatre-Zilgien
5,963,131 A 10/1999 D'Angelo et al.
6,011,473 A 1/2000 Klein
6,075,443 A 6/2000 Schepps et al.
6,183,417 B1 2/2001 Geheb et al.
6,299,584 B1 10/2001 Iseberg
6,434,512 B1 * 8/2002 Discenzo ..... F16C 19/52 702/184
6,734,795 B2 5/2004 Price
6,749,566 B2 6/2004 Russ
6,869,401 B2 3/2005 Gilbert et al.
7,009,516 B2 3/2006 Enea
7,036,984 B2 5/2006 Penney et al.
7,210,164 B1 4/2007 Jandrell
7,301,451 B2 11/2007 Hastings
7,316,648 B2 1/2008 Kelly et al.
7,471,203 B2 12/2008 Worthy et al.
7,510,526 B2 3/2009 Merry et al.
7,535,357 B2 5/2009 Enitan et al.
7,557,710 B2 7/2009 Sanchez et al.
7,617,137 B2 11/2009 Kreiner et al.
7,696,871 B2 4/2010 Villiger
7,722,249 B2 * 5/2010 Kim ..... G01K 1/024 374/163
7,749,170 B2 7/2010 Waldhoff et al.
7,755,482 B2 7/2010 Hubbard
7,768,391 B2 * 8/2010 Koyama ..... A61B 5/0002 257/679
7,774,242 B2 8/2010 Kubach et al.
7,794,142 B2 9/2010 Clothier et al.
7,864,049 B2 1/2011 Scott et al.
7,898,414 B2 3/2011 Spano
8,020,768 B2 9/2011 Ramos-Elizondo et al.
8,066,639 B2 11/2011 Nelson et al.
8,181,860 B2 5/2012 Fleck et al.
8,188,409 B2 5/2012 Baier
8,378,823 B2 2/2013 Eckert et al.
8,477,032 B2 7/2013 Bergman et al.
8,680,999 B2 3/2014 Wood
8,981,934 B2 3/2015 Wood
9,183,738 B1 * 11/2015 Allen, Sr. ..... A61B 5/6807
2002/0177448 A1 11/2002 Moran et al.
2003/0069752 A1 4/2003 LeDain et al.
2003/0189488 A1 10/2003 Forcier et al.
2003/0212311 A1 11/2003 Nova et al.
2004/0019258 A1 1/2004 Kavounas et al.
2005/0148339 A1 7/2005 Boman et al.
2005/0154327 A1 * 7/2005 Nakazawa ..... G01K 15/00 600/549
2005/0285739 A1 12/2005 Velhal et al.
2005/0288571 A1 12/2005 Perkins et al.
2006/0038676 A1 * 2/2006 Richards ..... G08B 21/0227 340/539.23
2006/0149322 A1 7/2006 Merry et al.
2006/0267575 A1 * 11/2006 Sampson ..... G08B 13/1427 324/110
2007/0040652 A1 2/2007 Quatro
2007/0096867 A1 * 5/2007 Denison ..... G06F 9/5066 340/5.23
2007/0120698 A1 5/2007 Turk et al.
2007/0135866 A1 6/2007 Baker et al.
2007/0186923 A1 8/2007 Poutiatine et al.
2007/0229258 A1 10/2007 Villiger
2007/0241261 A1 * 10/2007 Wendt ..... G01D 9/005 250/221
2008/0077026 A1 3/2008 Banet et al.
2008/0169904 A1 7/2008 Schulman et al.
2008/0209965 A1 * 9/2008 Maack ..... G06F 21/554 70/262
2008/0312852 A1 * 12/2008 Maack ..... A61N 1/3708 702/63
2009/0112626 A1 4/2009 Talbot et al.
2009/0124870 A1 5/2009 Arends et al.
2009/0149894 A1 * 6/2009 Merry ..... A61N 1/39 607/2
2009/0160670 A1 6/2009 Sipple
2009/0243836 A1 * 10/2009 McSheffrey ..... A61N 1/39 340/524
2009/0273485 A1 11/2009 Wike
2010/0045456 A1 2/2010 Koennecke et al.
2010/0070196 A1 3/2010 Drucker et al.
2010/0286527 A1 11/2010 Cannon et al.
2011/0004502 A1 * 1/2011 Dillard ..... G06Q 10/06 705/7.34
2011/0054296 A1 3/2011 McCarthy et al.
2011/0105904 A1 5/2011 Watanabe
2011/0158284 A1 6/2011 Goto
2011/0160595 A1 6/2011 Stone et al.
2012/0165688 A1 6/2012 Liu et al.
2013/0287060 A1 * 10/2013 Langdoc ..... G01J 5/0003 374/121
2016/0143630 A1 * 5/2016 Pardey ..... A61B 10/0012 600/549
2016/0213324 A1 * 7/2016 Gil ..... A61B 5/7278

FOREIGN PATENT DOCUMENTS

JP 2002507036 A 3/2002
KR 20010071222 A 7/2001
KR 10-2011-0052145 5/2011
KR 10-2013-0012286 2/2013
WO 2009124108 A1 10/2009

OTHER PUBLICATIONS

Akass, Nia Portable Alarm, the INQUIRER, Sep. 17, 2009, 2 pages.
Vila, Infrared Protection System, Journal: Revista Espanola de Electronica, vol. 32, No. 367, p. 36-39, Spain, Jun. 1985.
Want et al., The Active Badge Location System, Olivetti Research Ltd., Cambridge, England, 10 pages.
Yang et al., EagleVision: A Pervasive Mobile Device Protection System, Iowa State Univ., Ames, IA, Jul. 2009, 10 pages.
Brown, M., "Ubiquitous Use of RFID in the Health Industry," Ethical Issues and Security Monitoring Trends in Global Healthcare: Technological Advancements, Chapter 12, pp. 166-178 (Copyright 2011).
Chen, M. et al., "A 2G-RFID-Based E-Healthcare System," IEEE Wireless Communications, vol. 17, No. 1, pp. 37-43 (Feb. 2010).
Cheng, D. et al., "Design Specification for a Remote Diagnostic System," Medicare Solutions, http://www2.ensc.sfu.ca/~whitmore/courses/ensc305/projects/2010/22desi.pdf, 50 pages (Nov. 14, 2010).
Data Loggers for Medical Applications, MadgeTech, http://www.madgetech.com/data-loggers/applications/medical.html, 9 pages (Date Accessed: Aug. 7, 2012).
Davenport, D. et al., "Wireless Propagation and Coexistence of Medical Body Sensor Networks for Ambulatory Patient Monitoring," Sixth International Workshop on Wearable and Implantable Body Sensor Networks, pp. 41-45 (Jun. 3-5, 2009).
Fineman, B., "Cause for Alarm? Patient monitoring and medical device alarms in the intensive care unit," http://mildabandon.com/metamonitor/MM_poster.pdf, 1 page (Date Accessed: Aug. 7, 2012).
George, A., "Medical Device Alerting: Avoiding Alarm Fatigue. Using alarm management systems to aid in workflow allows caregivers to better manage the vast number of medical device alarms—and avoid fatal patient consequences," http://healthcare-executive-

(56) References Cited

OTHER PUBLICATIONS insight.advanceweb.com/Web-Extras/Online-Extras/Medical-Device-Alerting-Avoiding-Alarm-Fatigue.aspx, 3 pages (Date Accessed: Aug. 7, 2012).
Hieronymi, U. et al., "Monitoring Systems," Springer Handbook of Medical Technology, Chapter 47, pp. 947-954 (2012).
HOBOnode Outdoor Wireless System User's Guide, Onset Computer Corporation, http://www.onsetcomp.com/files/manual_pdfs/12473-J-MAN-HOBOnode-UG.pdf, 53 pages (Copyright 2009-2012).
Infinity M540 monitor; Infinity M500 docking station, Drager, http://www.draeger.com/media/10/08/42/10084252/m540-m500-9066285-ds-en.pdf, 8 pages (Copyright 2011).
Infrared thermometer with alarm, Item No. YO-95001-19, http://www.coleparmer.com/buy/product/93179-infrared-thermometer-alarm-optimized-measuring-body-temperatu.html, Cole-Parmer, 2 pages (Date Accessed: Aug. 7, 2012).
IntelliVue Patient Monitor MP20/30, MP40/50, MP60/70/80/90 Release G.0 with Software Revision G.0x.xx, Philips, 496 pages (Sep. 2008).
International Search Report and Written Opinion for PCT/US2014/018334 mailed Jun. 11, 2014.
Kinley, R., "Lost Item Pager: Project Description," http://eet.etec.wwu.edu/kinleyr/project/docs/Project%20Description.pdf, 12 pages (Date Accessed: Aug. 7, 2012).
Ko, J. et al., "Wireless Sensor Networks for Healthcare," Proceedings of the IEEE, vol. 98, No. 11, pp. 1947-1960 (Nov. 2010).
Lukowicz, P. et al., "AMON: A Wearable Medical Computer for High Risk Patients," Proceedings of the 6th International Symposium on Wearable Computers (ISWC '02), pp. 133-134 (2002).
Naima, R. et al., "The Berkeley Tricorder: Ambulatory Health Monitoring," 6th International Workshop on Wearable and Implantable Body Sensor Networks, pp. 53-58 (Jun. 3-5, 2009).
Najera, P. et al., "Real-time location and inpatient care systems based on passive RFID," Journal of Network and Computer Applications, vol. 3, No. 1, pp. 980-989 (May 2011).
Panagiotis, K. et al., "Radio Frequency Identification (RFID) in a Hospital Environment," The Journal on Information Technology in Healthcare, vol. 4, No. 2, pp. 83-91 (2006).
Rahman, F. et al., "Design of a Wireless Physiological Parameter Measurement and Monitoring System," International Conference on Computer Engineering & Systems, 2007. ICCES '07, pp. 401-405 (Nov. 27-29, 2007).
uPager—Find your lost items with the push of a button, http://www.upager.com, 3 pages (Date Accessed: Aug. 7, 2012).
Watson, B., "Truly Wireless EMG!," http://www.zflomotion.com/blog/bid/184689/Truly-Wireless-EMG, 3 pages (Posted Jul. 6, 2012).

* cited by examiner

ANTI-LOSS FOR MEDICAL DEVICES

BACKGROUND

Wireless handheld medical devices are being used more and more in hospitals and in other medical settings. Because the wireless medical devices are not tethered, via a wire or cable, to a base station, the wireless handheld medical devices may be susceptible to loss and theft.

One type of wireless handheld medical device is a thermometer probe. A wireless thermometer probe is particularly susceptible to loss and theft. For example, the wireless thermometer probe may be removed from a docking station, used for a temperature measurement and not returned to the docking station. The wireless thermometer probe may be inadvertently left in a patient's bed and get lost or thrown out in the bed sheets, or a clinician may place the wireless thermometer in a pocket and forget to return the wireless thermometer to the docking station. The wireless thermometer probe is also susceptible to theft.

SUMMARY

Embodiments of the disclosure are directed to a medical device system that includes one or more anti-loss/anti-theft mechanisms. The medical device system comprises a wireless medical device and a docking station. The wireless medical device includes a wireless medical sensor. An alarm is activated on one or more of the wireless medical device or the docking station when an alarm threshold is detected by one of the anti-loss/anti-theft mechanisms.

In another aspect, a method for preventing loss or theft of a wireless medical device includes removing the wireless medical device from a docking station. When the wireless medical device is removed from the docking station, a parameter associated with the wireless medical device and the docking station is monitored. A determination is made as to whether the parameter exceeds a first threshold. When the parameter exceeds the first threshold, an alarm is activated.

In yet another aspect, an electronic computing device comprises a processing unit and system memory. The system memory includes instructions that when executed by the processing unit cause the electronic computing device to: process a clinician authentication; when a determination is made that the clinician is authorized, release a wireless medical device from the electronic computing device; display identification information for the clinician on the electronic computing device; start a timer when the wireless medical device is released from the electronic computing device; determine whether the wireless medical device has been returned to the electronic computing device within a predetermined time interval; and when a determination is made that the wireless medical device has not been returned to the electronic computing device within the predetermined time interval, activate an alarm on the wireless medical device.

The details of one or more techniques are set forth in the accompanying drawings and the description below. Other features, objects, and advantages of these techniques will be apparent from the description, drawings, and claims.

DETAILED DESCRIPTION

Figure 1:
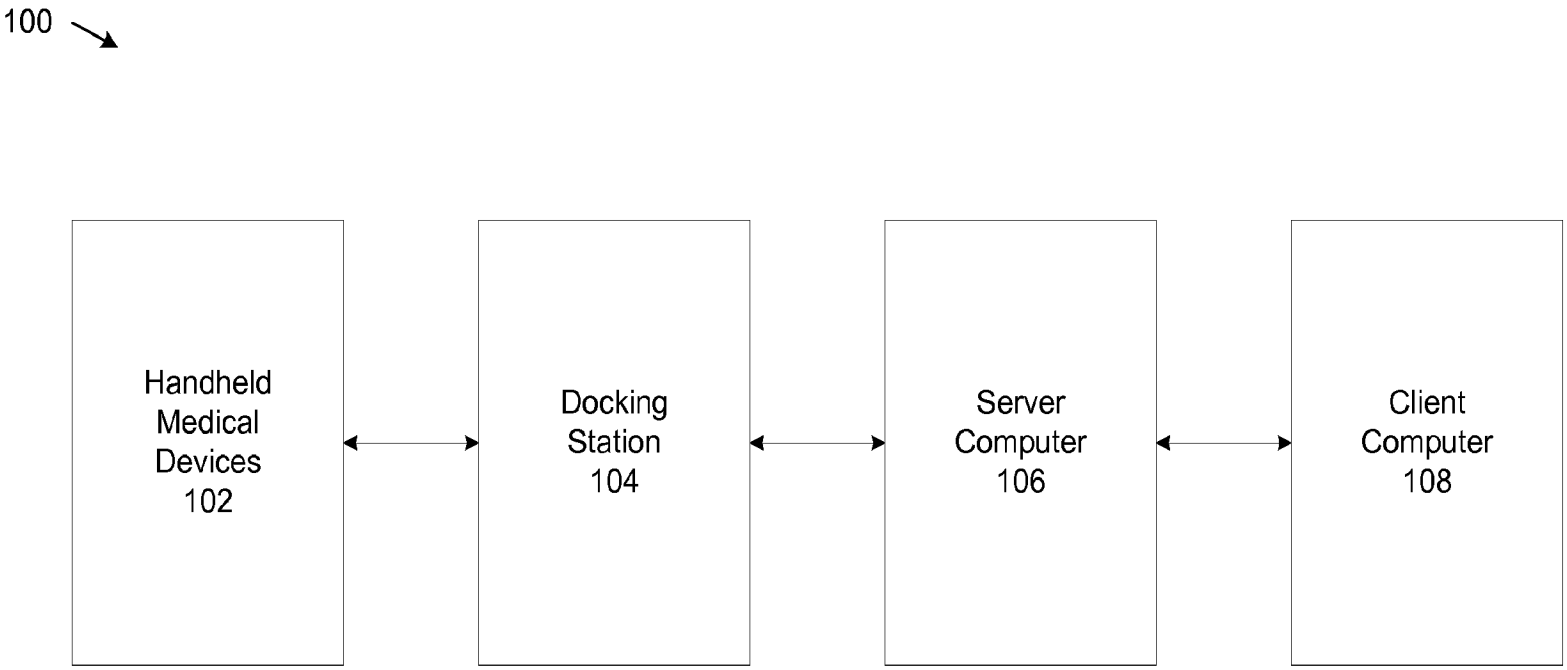
FIG. 1 shows an example system that supports an anti-loss mechanism for a wireless thermometer probe.

The present disclosure is directed to anti-loss/anti-theft mechanisms for handheld medical devices, particularly wireless medical devices such as wireless thermometer probes. In this context, a wireless thermometer probe is a temperature sensing device that supports a wireless connection to a docking station.

The docking station may be a medical device that displays temperature measurements and other vital sign measurements. The docking station may also be a medical device dedicated to displaying temperature measurements. An example of a docking station that displays temperature measurements and other vital signs measurements is the Connex® Vital Signs Monitor from Welch Allyn, Inc. of Skaneateles Falls, N.Y. An example of a docking station that is dedicated to displaying temperature measurements is the Sure Temp® electronic thermometer from Welch Allyn.

Typically, a clinician removes the wireless thermometer probe from the docking station, takes a temperature reading of a patient and re-inserts the wireless thermometer probe in the docking station. After the temperature measurement is completed, the temperature of the patient may be wirelessly transmitted from the wireless thermometer probe to the docking station and displayed on the docking station. The wireless thermometer probe and the docking station each include a communication interface, for example Bluetooth, near field communication (NFC), ZigBee, ultra-wide-band, ultrasound, infrared, WIFI, radio-frequency identification (RFID) etc., for establishing a wireless connection between the wireless thermometer probe and the docking station and for transmitting the temperature measurement from the wireless thermometer probe to the docking station.

The docking station may also be a holder for a wireless thermometer or other medical device. For example, the wireless thermometer may be docked on a shelf or other holding device. The wireless thermometer may consist of the wireless thermometer probe and a base station (docking station) for the wireless thermometer. In this example, the clinician may remove the wireless thermometer from the holder, then remove the wireless thermometer probe from the wireless thermometer and take a temperature reading of the patient. After the temperature reading is completed, the wireless thermometer probe is reinserted in the wireless thermometer and then the wireless thermometer is put back in the holder. In another example, the wireless thermometer may be a self-contained unit such as a wireless ear thermometer, used to take a patient's temperature via an ear of the patient. The wireless ear thermometer may be removed from the holder and then placed back in the holder after a temperature measurement is taken.

In this disclosure, the anti-loss/anti-theft mechanisms are described for wireless thermometer probes and for wireless thermometers. However, the anti-loss/anti-theft mechanisms described in this disclosure may also apply to other wireless medical devices besides wireless thermometer probes and wireless thermometers. For example, the anti-loss/anti-theft mechanisms may apply to such wireless medical devices as wireless blood pressure cuffs, wireless oxygen saturation sensors or other wireless medical devices.

FIG. 1 shows an example system 100 that supports wireless medical devices. The system 100 includes handheld medical devices 102, a docking station 104, a server computer 106 and a client computer 108. The example handheld medical devices 102 may include a plurality of handheld medical devices, including wireless thermometer probes and wireless thermometers. Other handheld medical devices may include such devices as wireless blood pressure cuffs, wireless oxygen saturation sensors, etc.

The example docking station 104 comprises a base station for the handheld medical devices 102. Typically, the docking station 104 provides display capability for measurements from the handheld medical devices 102. In some examples, one or more handheld medical devices 102, for example a wireless thermometer probe, may also provide display capability for measurements. For example, there may be a small display window built into the wireless thermometer probe. The example docking station 104 includes a wireless connection interface, for example Bluetooth, for supporting a wireless connection to a wireless thermometer probe and to other wireless handheld medical devices.

The example server computer 106 receives patient vital signs data from docking station 104 and from other docking stations (not shown) in system 100. The server computer 106 may be part of an electronic medical records (EMR) system for storing patient data. The server computer 106 may also download configuration data and software updates to docking stations in system 100.

The example client computer 108 is a client computer in a hospital or other medical setting. As discussed later herein, the client computer 108 includes an interface, for example a USB port, for identifying a wireless thermometer probe. In some examples the client computer 108 may have a connection to the server computer 106. More than one client computer 108 may be used. Other interfaces than a USB port may be used.

The example system 100 provides one or more anti-loss/anti-theft mechanisms for handheld medical devices, including wireless thermometer probes and wireless thermometers. The anti-loss/anti-theft mechanisms apply across multiple levels of connectivity. When the handheld medical device is a wireless thermometer, the anti-loss/anti-theft mechanisms apply between the wireless thermometer probe and the base station (docking station) of the wireless thermometer. When the handheld medical device is a wireless thermometer probe, the anti-loss/anti-theft mechanisms apply between the wireless thermometer probe and docking station for the wireless thermometer probe, for example the Connex® Vital Signs Monitor.

When the wireless thermometer is stored in a holder, such as a shelf, the anti-loss/anti-theft mechanisms apply between the wireless thermometer probe and the base station of the wireless thermometer and also apply between the wireless thermometer and the holder. In this case, the anti-loss/anti-theft mechanisms protect against loss or theft of the wireless thermometer probe from the base station of the wireless thermometer and also protect against loss or theft of the wireless thermometer from the holder.

Figure 2:
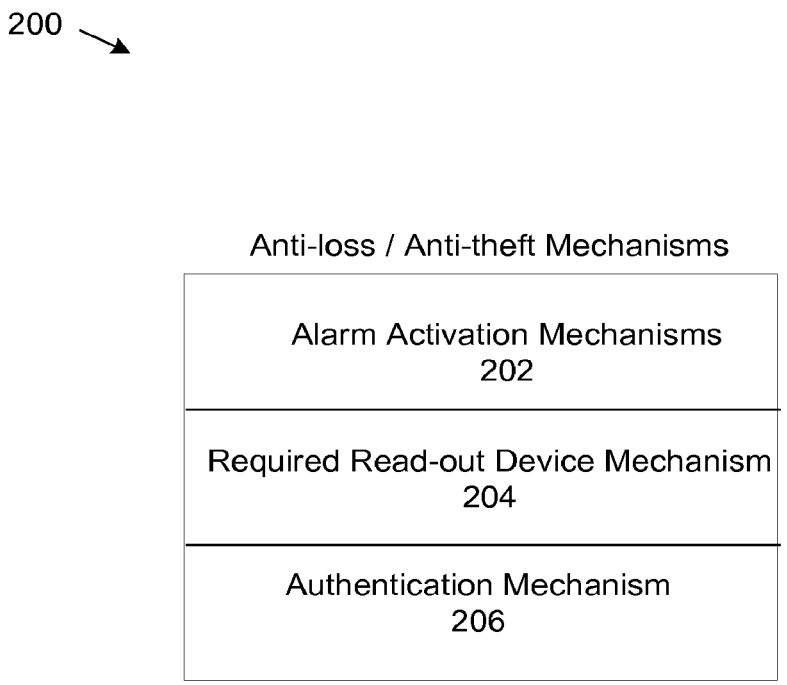
FIG. 2 lists example anti-loss/anti-theft mechanisms.

Some example anti-loss/anti-theft mechanisms 200 are listed in FIG. 2. The example anti-loss/anti-theft mechanisms include alarm activation mechanisms 202, a required read-out device mechanism 204 and an authentication mechanism 206.

The example alarm activation mechanisms 202 include four mechanisms, discussed in more detail later herein, which involve activating an alarm when a particular condition or group of conditions occur. The condition or group of conditions include: 1) when a time that a hand-held medical device is out of its docking station exceeds a time threshold, 2) when a distance that the hand-held medical device is from its docking station exceeds a distance threshold, 3) when a distance that the hand-held medical device is away from a buddy device exceeds a distance threshold and/or 4) an activation of a pager system. Other alarm activation mechanisms 202 are possible.

For the example required read-out device mechanism 204, the wireless thermometer probe and the docking station 104 are configured such that a temperature measurement taken using the wireless thermometer probe can only be displayed when the wireless thermometer probe is returned to the docking station 104. Before the docking station 104 displays the temperature measurement, the docking station 104 verifies the identity of the wireless thermometer probe. The docking station 104 only displays the temperature measurement after a determination is made that the identity of the wireless thermometer probe indicates that the wireless thermometer probe is associated with the docking station 104. The temperature measurement can be prevented from being displayed on any other docking station and on any client computer. The required read-out device mechanism 204 provides an incentive against loss or theft, because the temperature measurement can only be displayed on the docking station that is associated with the wireless thermometer probe, in this example docking station 104.

For the example authentication mechanism 206, before the wireless thermometer probe can be removed from the docking station 104, the wireless thermometer probe needs to be authenticated with a clinician's badge. In some examples, the docking station 104 includes a sensor device that authenticates the clinician, for example when the clinician's badge touches or comes in close proximity to the sensor device. In some examples, once authenticated, any handheld medical device 102 associated with docking station 104 may be released from the docking station 104. In other examples, the clinician selects a handheld medical device before authenticating.

The docking station 104 retains a history of clinicians that authenticate with the docking station 104. The history provides an indication of which clinicians removed a handheld medical device 102. In some examples, the docking station 104 displays a photograph of the clinician that removed the handheld medical device 102 from the docking station 104.

Figure 3:
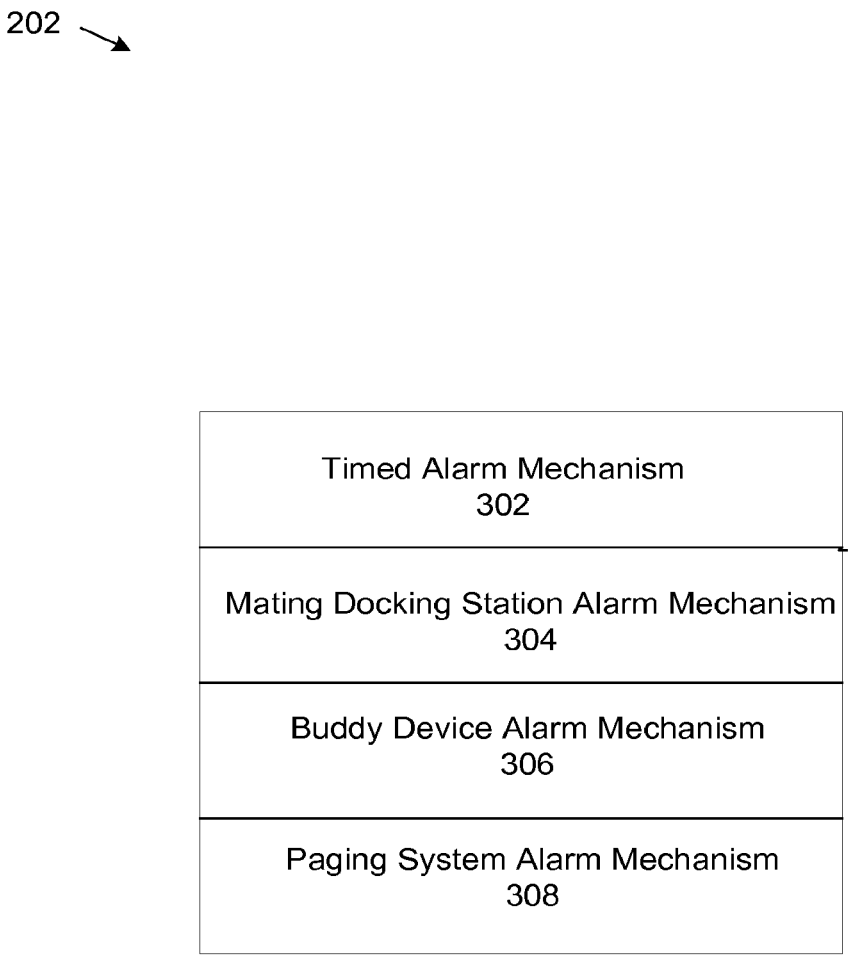
FIG. 3 lists example alarm activation mechanisms.

FIG. 3 lists four example alarm activation mechanisms 202. The four example alarm activation mechanisms 202 include a timed alarm mechanism 302, a mating docking station alarm mechanism 304, a buddy device alarm mechanism 306 and a paging system alarm mechanism 308. Other alarm activation mechanisms are possible.

For the timed alarm mechanism 302, a relationship is maintained between a wireless thermometer probe and a docking station. In this disclosure, the wireless thermometer probe is one of the handheld medical devices 102 and the docking station is docking station 104.

Docking station 104 monitors a state of the temperature measurement process. Example states include 1) not started—wireless thermometer probe is in docking station; 2) wireless thermometer probe is removed from the docking station; 3) a temperature measurement has started; 4) the temperature measurement has been completed; and 5) the wireless thermometer probe has been returned to docking station 104. Other states are possible. When software on docking station 104 determines that the wireless thermometer probe has been out of docking station 104 and has been in an idle state for greater than a predetermined period of time, docking station 104 may activate an alarm. The idle state may be a time from state 1 when the wireless thermometer probe is removed from docking station 104 and state 2, when a temperature reading is not started within a first time threshold. In some examples, the threshold can be determined based on an amount of time that starting the temperature reading could reasonably take. Examples of the threshold could include 30 seconds, 45 seconds, 1 minute, 2 minutes, 5 minutes, etc. The idle state may also be a time from state 4, when the temperature measurement has been completed and state 5, when the wireless thermometer probe has not been returned to docking station 104 within the predetermined period of time. In some examples, the predetermined period of time may be different for the two alarm conditions above.

For the mating docking station alarm mechanism 304, the wireless thermometer probe is electronically mated to docking station 104. The electronic mating of the wireless thermometer probe to docking station 104 comprises creating an association between the wireless thermometer probe and docking station 104, storing an identifier for docking station 104 on the wireless thermometer probe and storing an identifier for the wireless thermometer probe on docking station 104. In some examples, the identifier for docking station 104 may be displayed on a display device on the wireless thermometer probe.

In some examples, the wireless thermometer probe is electronically mated to docking station 104 automatically when the wireless thermometer probe is physically inserted into docking station 104. In other examples, the wireless thermometer probe and the docking station 104 may be configured to be mated to each other. In some examples, the configuration may be performed remotely, for example from server computer 106 or from a client computer 108. In some examples, the configuration may be time based. In a time-based mating, the wireless thermometer probe and the docking station 104 are mated for a configured period of time.

For a distance-based mating, when the wireless thermometer probe is removed from docking station 104, docking station 104 keeps track of a distance between the wireless thermometer probe and docking station 104. When the distance between the wireless thermometer probe and docking station 104 is greater than a predetermined distance, an alarm is activated on docking station 104 and on the wireless thermometer probe. The distance is typically determined using a form of near field communication, for example using Bluetooth between the wireless thermometer probe and the docking station. For the time-based mating, the alarm is generated when the configured period of time expires.

When the identifier for docking station 104 is stored on the wireless thermometer probe, whenever the wireless thermometer probe is out of range of docking station 104, the wireless thermometer probe may be inserted in an interface, for example a USB port, of a computer, for example client computer 108, to obtain the identity of docking station 104 to which the wireless thermometer probe is mated. In this example, client computer 108 includes software that reads the identifier of docking station 104 from the wireless thermometer probe and displays the identifier on a screen of client computer 108.

For the buddy device alarm mechanism 306, an association is made between a buddy device and a clinician. For example, the buddy device may be a wireless thermometer probe or a docking station. As discussed, herein the buddy device is the wireless thermometer probe. In this example mechanism, the wireless thermometer probe and the clinician comprise a buddy system. When the wireless thermometer probe is moved out of range of the clinician an alarm is activated on the wireless thermometer probe. In this example mechanism, the wireless thermometer probe is not used with a docking station. Instead, the wireless thermometer probe includes a display device for displaying a temperature measurement. To determine distance, the clinician may wear a device, such as a badge, that communicates with the wireless thermometer probe and determines a distance between the clinician and the wireless thermometer probe. The communication is typically via a communication protocol such as Bluetooth, ZigBee, etc. In some examples, magnetic switches, proximity sensors or capacitive sensing may be used to determine distance.

For the paging system alarm mechanism 308, a paging device is added to wireless thermometer probe and docking station 104. In some examples, docking station 104 includes a paging button. Pressing the paging button on docking station 104 activates an alarm on the wireless thermometer probe.

The alarm that is activated when a particular condition or group of conditions occur is an indicator that the condition has been met. Such an alarm can take an audible form (e.g., an audible alert that is played), a visual form (e.g., a light is flashed), or a textual alarm (e.g., a text message is displayed and/or communicated via a network to another device in the form of, for example, a text message and/or email). Combinations of these types of alarms can also be used.

Figure 4:
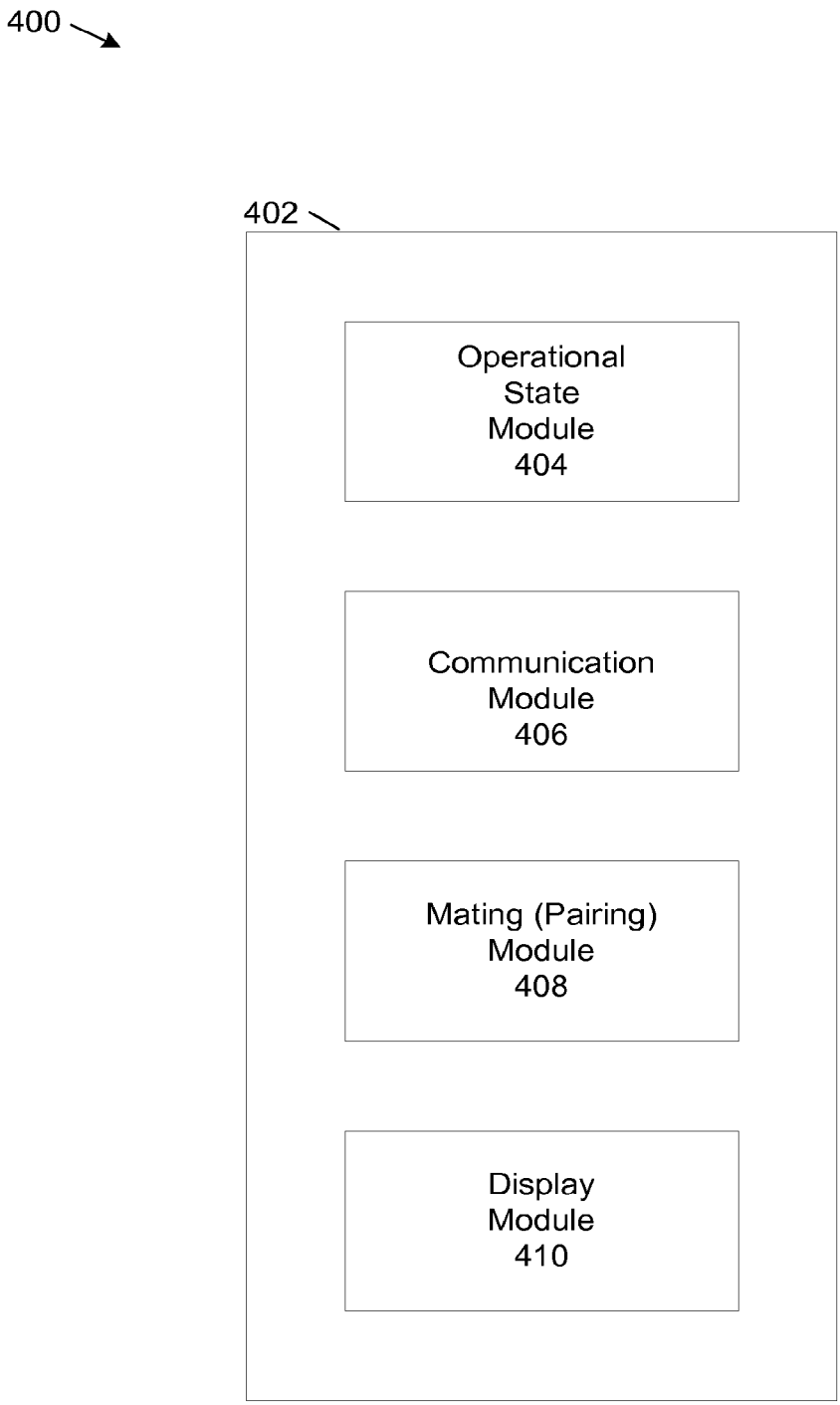
FIG. 4 shows example modules of one of the handheld medical devices of FIG. 1.

FIG. 4 shows example modules 400 of a wireless thermometer probe 402. The example wireless thermometer probe 402 includes an operational state module 404, a communication module 406, a mating (pairing) module 408 and a display module 410.

The example operational state module 404 monitors and stores status of operational states that comprise a temperature measurement process using wireless thermometer probe 402. Example states in the temperature measurement process include 1) removing wireless thermometer probe 402 from docking station 104, 2) taking a temperature measurement of a patient and 3) replacing wireless thermometer probe 402 in docking station 104. Other states are possible.

The example communication module 406 provides a communication interface for wireless thermometer probe 402 for communicating with docking station 104. In some examples, the communication interface supports Bluetooth. In other examples, the communication interface supports communication protocols like ZigBee, ultra-wide-band and others. The communication interface, as implemented in communication module 406, permits data and control information to be communicated between wireless thermometer probe 402 and docking station 104. The communication interface also permits a determination to be made of a distance between wireless thermometer probe 402 and docking station 104.

The example mating module 408 implements an electronic mating between wireless thermometer probe 402 and docking station 104. The electronic mating associates an identifier with wireless thermometer probe 402 and an identifier for docking station 104. In some examples, the identifier for wireless thermometer probe 402 may be displayed on a display device built into wireless thermometer probe 402. In other examples, wireless thermometer probe 402 may have a connector, for example a universal serial bus (USB) connector, in lieu of a display device. In some examples, the mating module 408 sends the identifiers for wireless thermometer probe 402 and docking station 104 to server computer 106. Server computer 106 permits the mating identification information to be displayed on a client computer, as explained later herein. In other examples, the server computer 106 is not required. In these examples the wireless thermometer probe 402 may be directly connected to the client computer or to docking station 104 and the identifiers may be displayed on the client computer or on docking station 104.

When wireless thermometer probe 402 is removed from docking station 104 and is moved a distance from docking station 104 that is greater than a threshold distance, an alarm may sound on wireless thermometer probe 402. For wireless thermometer probes that include a display device, the identifier for docking station 104 is displayed on the wireless thermometer probe display device. The display of the identifier for docking station 104 on the wireless thermometer probe display device permits a clinician to identify and locate the docking station, in this case docking station 104, which is mated to the wireless thermometer probe. For a wireless thermometer probe that includes a USB connector, the clinician may insert the USB connector into any client computer, for example client computer 108, which is networked to server computer 106. When wireless thermometer probe 402 is inserted into a USB connector on client computer 108, the identity and location of docking station 104 is displayed on client computer 108.

The example display module 410 permits a display of information on a display device of wireless thermometer probes that have a display device. In some examples, the information may include an identifier for the wireless thermometer probe. In some examples, the information may also include an identifier and location for docking station 104. In other examples, the information may also include a most recent temperature reading for a patient. In some examples, such as an implementation using required read-out device mechanism 204, the wireless thermometer probe does not include a display device or a display module 410.

Figure 5:
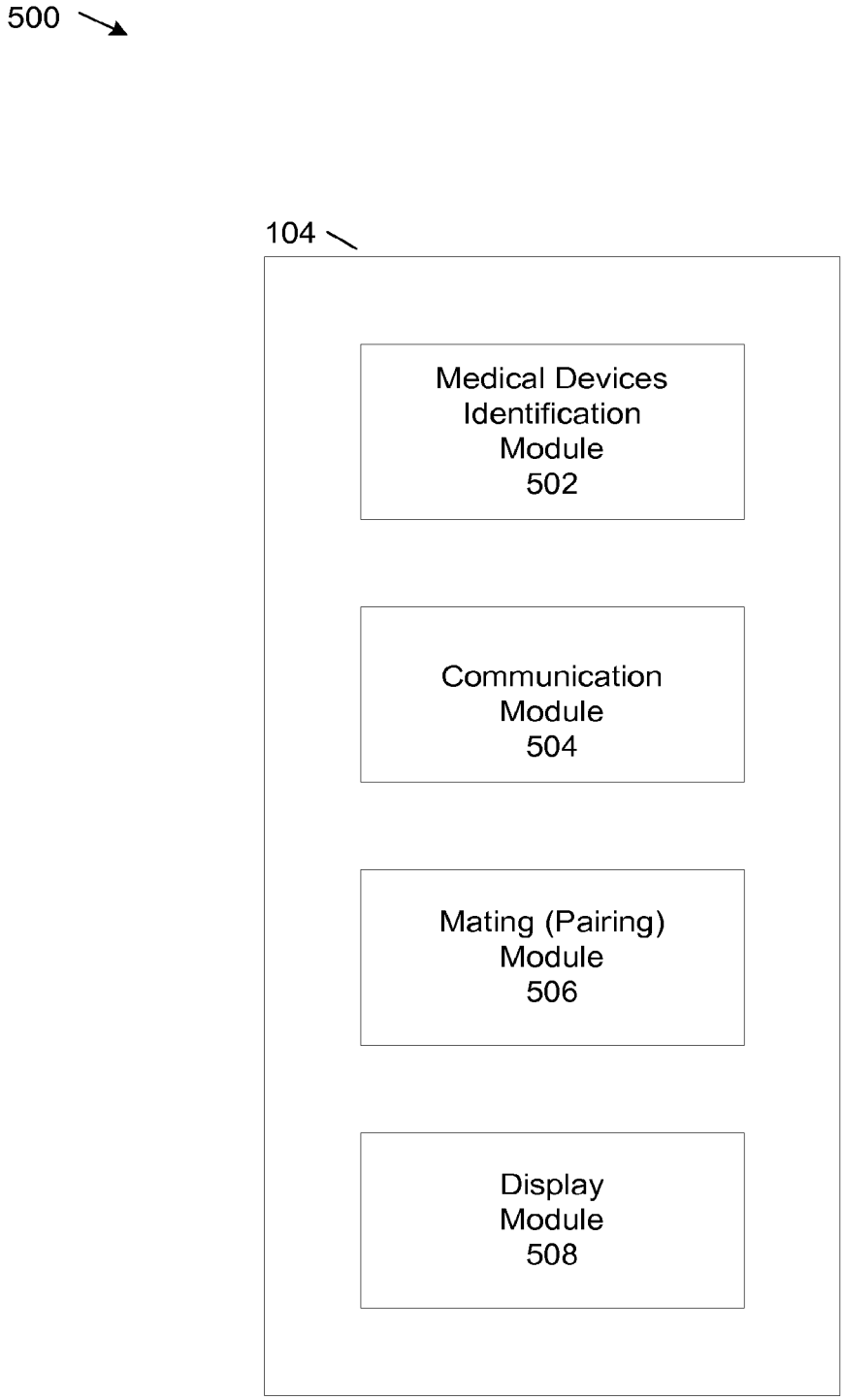
FIG. 5 shows example modules of the docking station of FIG. 1.

FIG. 5 shows example modules 500 of docking station 104. The example modules 500 include a medical devices identification module 502, a communication module 504, a mating module 506 and a display module 508.

The example medical devices identification module stores identifiers for each of the handheld medical devices 102. The handheld medical devices 102 may include blood pressure cuffs, oxygen saturation sensors, thermometer probes, ECG sensors, etc.

The example communication module 504 provides a communication interface for docking station 104 for communicating with wireless thermometer probe 402. In some examples, the communication interface supports Bluetooth. In other examples, the communication interface supports communication protocols like ZigBee, ultra-wide-band and others. The communication interface as implemented in communication module 504 permits data and control information to be communicated between docking station 104 and wireless thermometer probe 402. The communication interface also permits a determination to be made of a distance between docking station 104 and wireless thermometer probe 402.

The example mating module 506 implements an electronic mating between wireless thermometer probe 402 and docking station 104. The electronic mating associates an identifier with wireless thermometer probe 402 and an identifier for docking station 104. The mating module 506 sends the identifiers for wireless thermometer probe 402 and docking station 104 to server computer 106. Server computer 106 permits the mating identification information to be displayed on a client computer. As discussed earlier herein, in some examples server computer 106 is not required. In these examples, the wireless thermometer probe 402 may be directly connected to the client computer or to docking station 104 to display the mating identification information.

The example display module 508 permits a display of information on docking station 104. The information may include identifiers for one or more of the handheld medical devices associated with docking station 104. The information may also include mating information for wireless thermometer probes that may be mated to docking station 104. In addition, the information may include current measurement data from the handheld medical devices 102 such as blood pressure readings, temperature, oxygen saturation, heart rate, etc.

Figure 6:
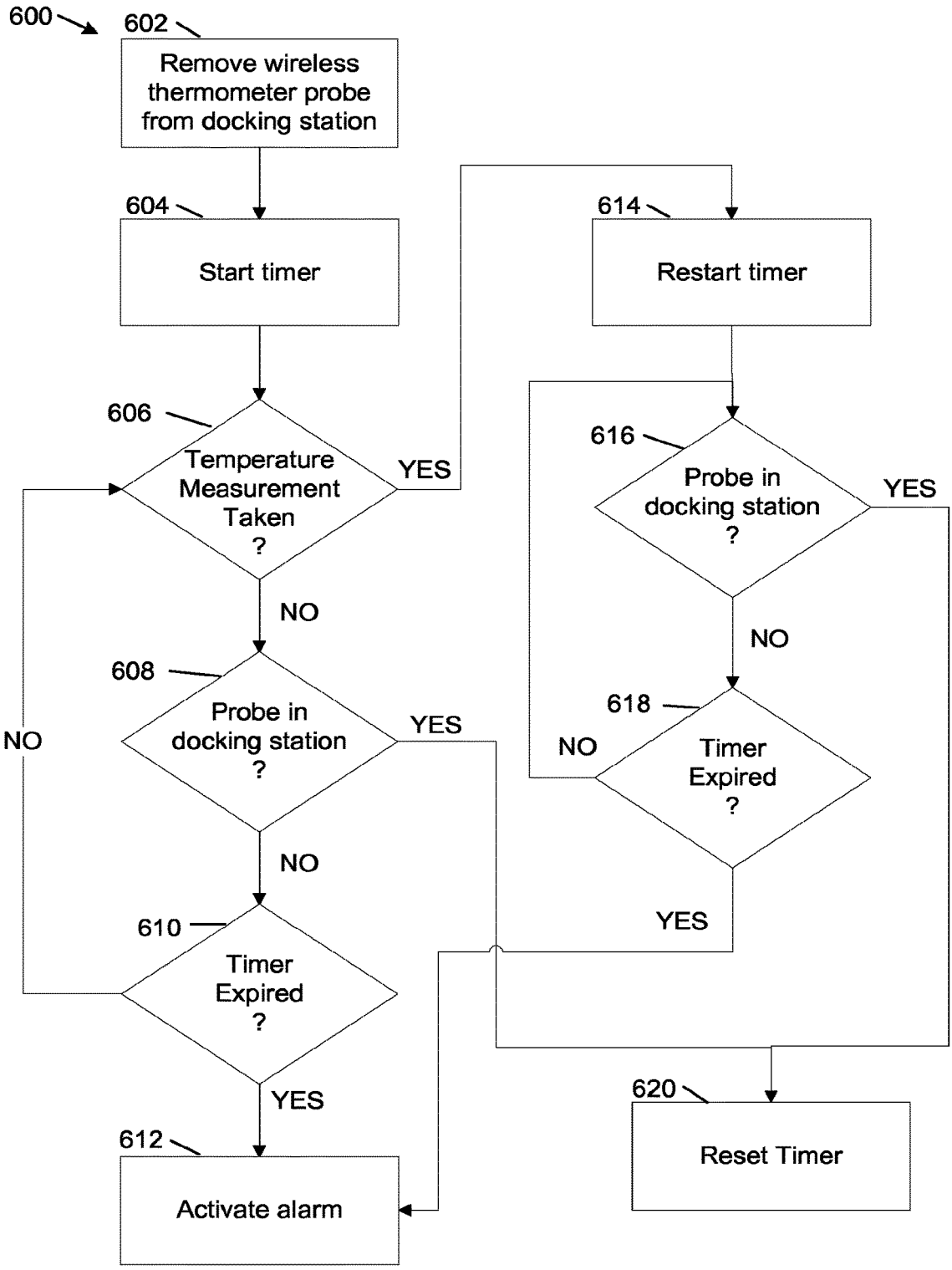
FIG. 6 shows an example flowchart for a first method for generating an alarm for the wireless thermometer probe and docking station.

FIG. 6 shows an example flowchart for a method 600 for implementing timed alarm mechanism 302. For the example method 600, an alarm is generated when a wireless thermometer probe is removed from the docking station 104 and not returned to the docking station 104 within a predetermined time interval.

At operation 602, the wireless thermometer probe is removed from the docking station 104. A state machine, typically in the docking station 104, changes from a state indicating that the wireless thermometer probe is in the docking station 104 to a state that indicates that the wireless thermometer probe has been removed from the docking station 104. In some examples, the state machine may be in the wireless thermometer probe 104.

At operation 604, a timer is started when the wireless thermometer probe is removed from the docking station 104. Typically, the timer is located within the docking station 104, but in some examples, the timer may be located within the wireless thermometer probe.

At operation 606, a determination is made as to whether a temperature measurement has been taken. At operation 606, when a determination is made that a temperature reading has not been taken, at operation 608, a determination is made as to whether the wireless thermometer probe has been returned to docking station 104. At operation 608, when a determination is made that the wireless thermometer probe has been returned to docking station 104, at operation 620 the timer is reset.

At operation 608, when a determination is made that the wireless thermometer probe has not been returned to the docking station 104, a determination is made as to whether the timer of operation 604 has expired. When a determination is made at operation 608 that the timer has not expired, control returns to operation 606. Operations 606, 608 and 610 are then repeated until a temperature measurement has been taken, the wireless thermometer probe has been returned to the docking station 104 or the timer has expired.

At operation 610, when a determination is made that the timer has expired, at operation 612, an alarm is activated. The activation of the alarm indicates that the timer has been out of the docking station 104 longer than the predetermined amount of time. The activation of the alarm may comprise one of several actions. Example actions include blinking an LED, activating an audible alarm, activating a voice command describing the alarm state. The example actions may occur on the wireless thermometer probe, the docking station 104 or on both the wireless thermometer probe and the docking station 104 simultaneously. Other example actions are possible, including causing the wireless thermometer probe to vibrate.

At operation 606, when a determination is made that the temperature measurement has been taken, in some examples, at operation 614, the timer is restarted. In addition the state machine is updated to a state indicating that the temperature measurement has been taken. In other examples, the timer is not restarted when the temperature measurement is taken. In the examples where the timer is not restarted when the temperature measurement is taken, the value of the timer reflects the time that the wireless thermometer probe is out of the docking station, regardless of whether a temperature reading has been taken.

At operation 616, a determination is made as to whether the wireless thermometer probe has been returned to docking station 104. At operation 616, when a determination is made that the wireless thermometer probe has been returned to docking station 104, at operation 620 the timer of operation 614 is reset.

At operation 616, when a determination is made that the wireless thermometer probe has not been returned to docking station 104, at operation 618, a determination is made as to whether the timer of operation 614 has expired. At operation 618, when a determination is made that the timer of operation 614 has expired, at operation 612 an alarm is activated.

Figure 7:
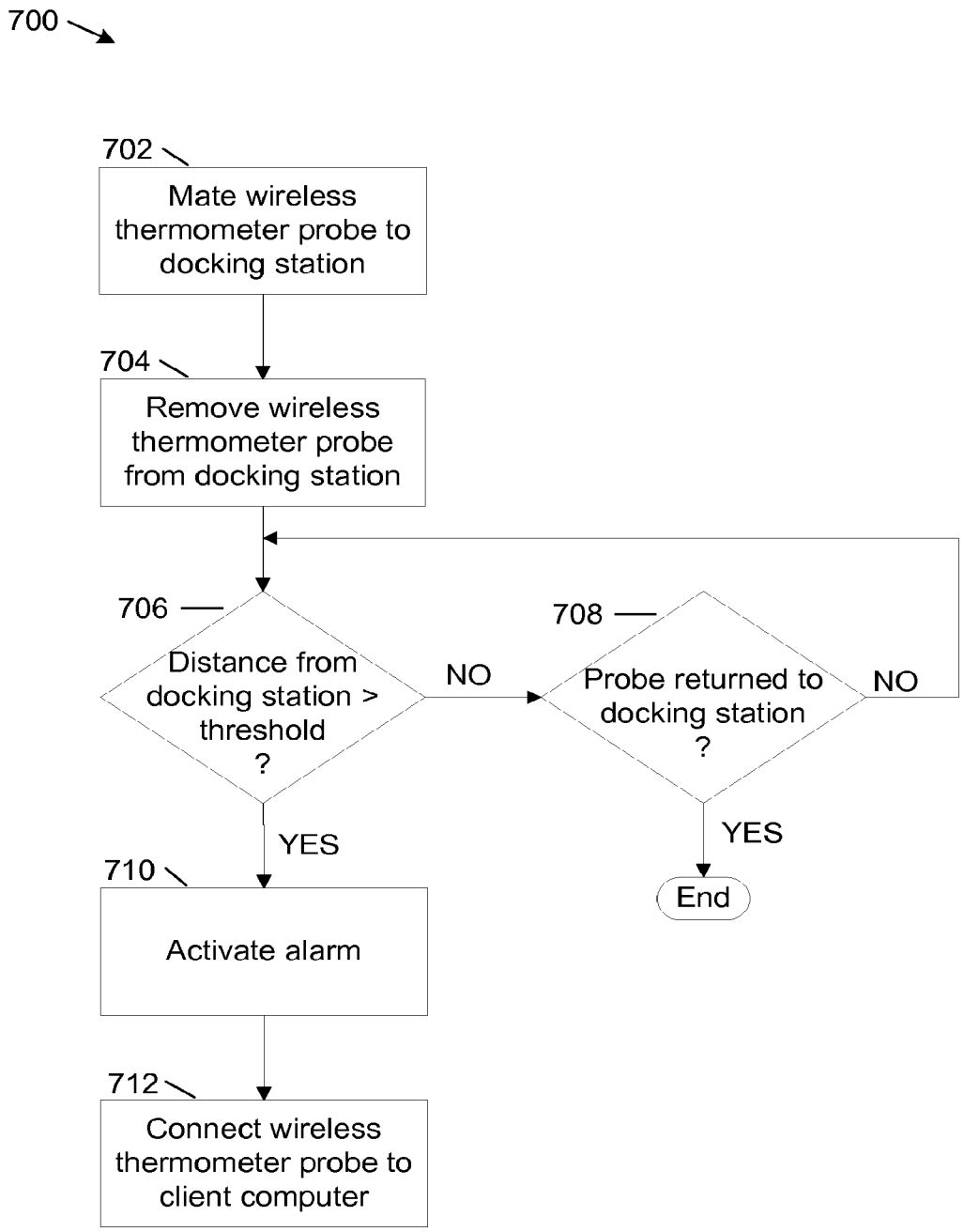
FIG. 7 shows an example flowchart for a second method for generating an alarm for the wireless thermometer probe and docking station.

FIG. 7 shows an example flowchart for a method 700 for implementing mating docking station alarm mechanism 304. For the example method 700, the wireless thermometer probe is mated to docking station 104. Mating the wireless thermometer probe to docking station 104 comprises configuring an association between the wireless thermometer probe and docking station 104.

At operation 702, the wireless thermometer probe is mated to docking station 104. At operation 704, the wireless thermometer probe is removed from docking station 104.

At operation 706, a determination is made as to whether the wireless thermometer probe is greater than a predetermined distance from docking station 104. The predetermined distance represents a distance which is greater than a normal operating distance for the wireless thermometer probe. For example, the predetermined distance may correspond to a dimension of a hospital room or a clinical area of an outpatient setting, the idea being that if the wireless thermometer probe is greater than the dimension of the room from docking station 104, a clinician or patient may have put the wireless thermometer probe in their pocket and may be walking away with the wireless thermometer probe.

At operation 706 when a determination is made that the wireless thermometer probe is not more than the predetermined distance from docking station 104, a determination is made as to whether the wireless thermometer probe has been returned to docking station 104. When a determination is made that the wireless thermometer probe has not been returned to docking station 104, control returns to operation 706. At operation 708, when a determination is made that the wireless thermometer probe has been returned to docking station 104, method 700 ends.

At operation 706, when a determination is made that the wireless thermometer probe is greater than the predetermined distance from docking station 104, an alarm is activated on either the wireless thermometer probe, docking station 104 or both. The alarm may comprise a blinking an LED, an audible alarm, a voice command describing the alarm state, a vibration of the wireless thermometer probe, or other similar type alarm.

At operation 712, when a user determines that an alarm has been activated, indicating that the wireless thermometer probe is greater than the predetermined distance from docking station 104, a clinician may connect the wireless thermometer probe to a client computer to display an identity of the docking station to which the wireless thermometer probe is mated. The wireless thermometer probe includes a connection, for example a USB connector, for connecting the wireless thermometer probe to the client computer.

Figure 8:
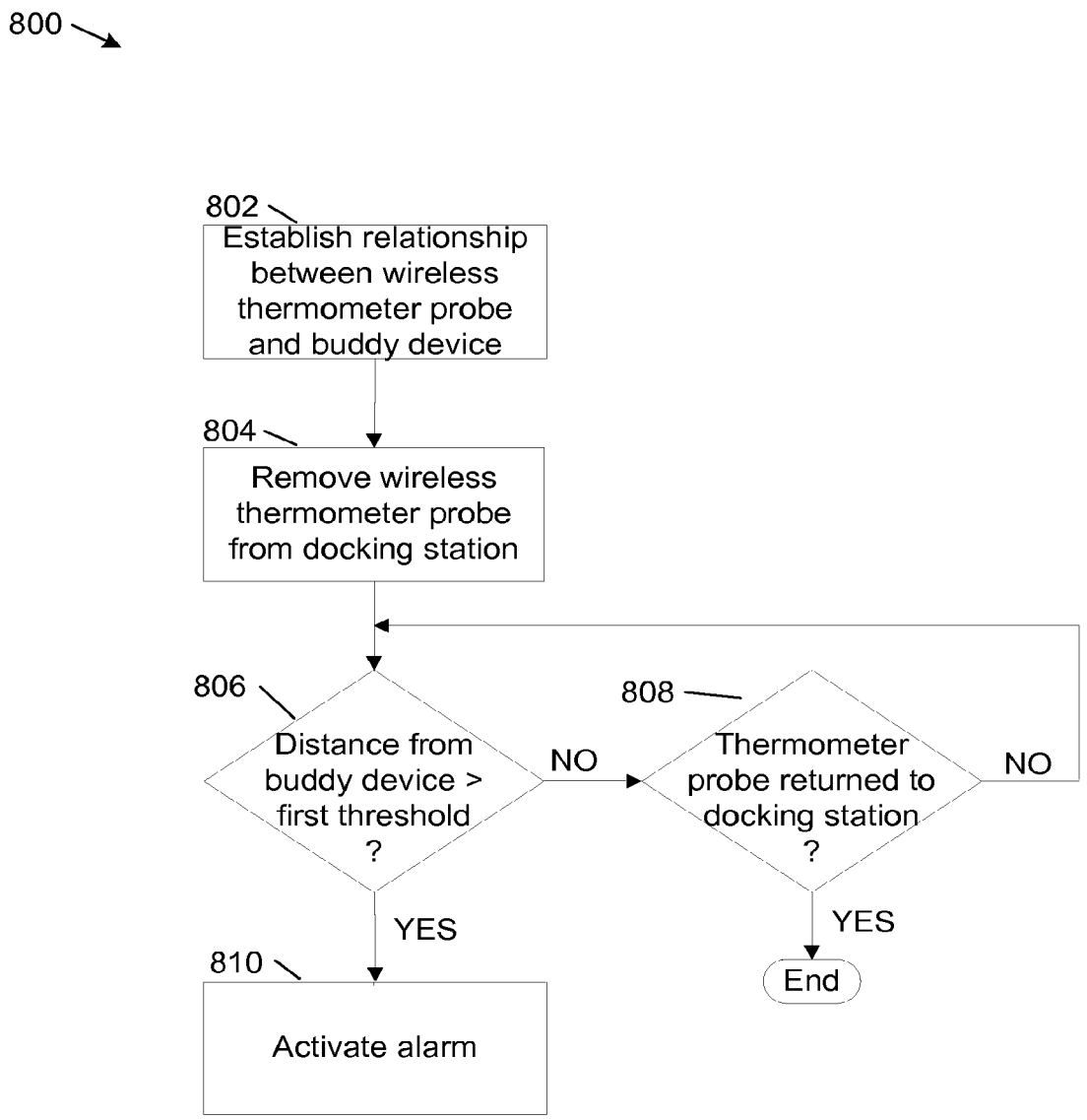
FIG. 8 shows an example flowchart for a third method for generating an alarm for the wireless thermometer probe and docking station.

FIG. 8 shows an example flowchart for a method 800 for implementing buddy device alarm mechanism 306. For the example method 800, a buddy system is used to protect against theft and loss. In this disclosure, a buddy system comprises establishing a relationship between a hand-held medical device, such as a wireless thermometer probe and a buddy device. The buddy device may be a docking station, for example docking station 104, a clinician's badge, or some other identifiable electronic device that can be associated with use of the hand-held medical device.

At operation 802, a relationship is established between the wireless thermometer probe and the buddy device. In the example method 800, the buddy device is either docking station 104 or a clinician's badge. The relationship is established by configuring the docking station 104 or the clinician's badge to have an association with the wireless thermometer probe. In some examples, both the docking station 104 and the clinician's badge may be buddy devices. In other examples, a different type of device may be a buddy device.

At operation 804, the wireless thermometer probe is removed from docking station 104. At operation 806, a determination is made as to whether a distance between the wireless thermometer probe and the buddy device is greater than a first threshold. One of several technologies may be used to determine the distance between the wireless thermometer probe and the buddy device. Examples of the technologies that may be used include near-field communication, such as Bluetooth, infrared, magnetic switching, proximity sensing, capacitive sensing, etc. Other technologies are possible.

At operation 806, when a determination is made that the distance between the wireless thermometer probe and the buddy device is not greater than the first threshold, at operation 808, a determination is made as to whether the wireless thermometer probe has been returned to docking station 104. When it is determined at operation 808 that the wireless thermometer probe has been returned to docking station 104, control returns to operation 806. When it is determined that the wireless thermometer probe has been returned to docking station 104, method 800 is terminated.

At operation 806, when a determination is made that the distance between the wireless thermometer probe and the buddy device is greater than the first threshold, at operation 810 an alarm is activated.

Figure 9:
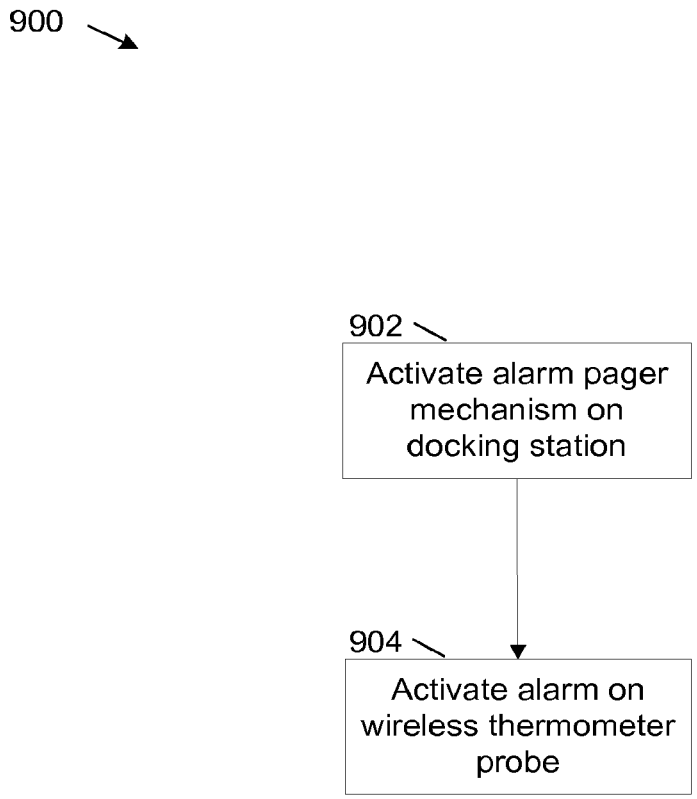
FIG. 9 shows an example flowchart for a fourth method for generating an alarm for the wireless thermometer probe and docking station.

FIG. 9 shows an example flowchart for a method 900 for implementing paging system alarm mechanism 308. For the example method 900, a hand-held medical device, for example the wireless thermometer probe, is tracked down by activating a pager alarm on a docking station. In some examples, activating a pager alarm comprises pressing a button on the docking station, for example on docking station 104. Other ways to activate the pager alarm are possible.

At operation 902, a pager alarm mechanism is activated on docking station 104. The pager alarm mechanism is commonly a button or switch on docking station 104. In some examples, the pager alarm mechanism may be remotely activated, for example from a central monitoring station or other remote computing device.

At operation 904, an alarm is activated on the wireless thermometer probe. The alarm may comprise a blinking an LED, an audible alarm, a voice command describing the alarm state, a vibration of the wireless thermometer probe, or other similar type alarm.

Figure 10:
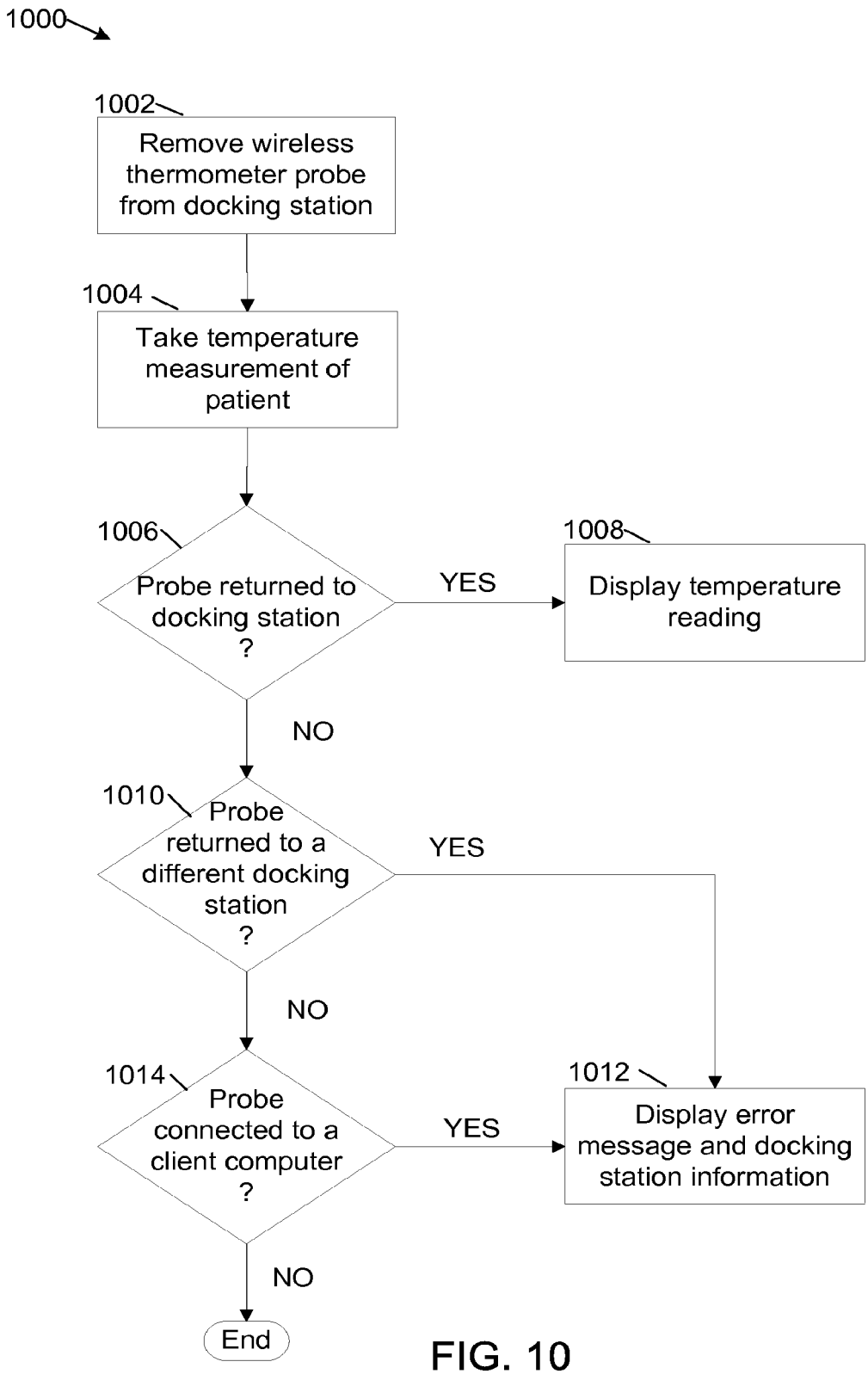
FIG. 10 shows an example flowchart for a required read-out device anti-loss mechanism.

FIG. 10 shows an example flowchart for a method 1000 for implementing required read-out device mechanism 204. For the example method 1000, a temperature reading is obtained from the wireless thermometer probe. The method 1000 provides that there is an association between the wireless thermometer probe and a docking station, for example docking station 104 and that a reading obtained by the wireless thermometer probe can also be displayed at docking station 104.

At operation 1002, the wireless thermometer probe is removed from docking station 104. At operation 1004, a temperature reading is obtained from a patient using the wireless thermometer probe.

At operation 1006, a determination is made as to whether the wireless thermometer probe has been returned to the docking station from which the wireless thermometer probe has been removed. At operation 1006, when a determination is made that the wireless thermometer probe has been returned to the docking station from which the wireless thermometer probe has been removed, at operation 1008, the temperature reading is displayed.

At operation 1006, when a determination is made that the wireless thermometer probe has not been returned to the docking station from which the wireless thermometer probe has been removed, at operation 1010, a determination is made as to whether the wireless thermometer probe has been returned to a different docking station.

At operation 1010, when a determination is made that the wireless thermometer probe has been returned to a different docking station, at operation 1012 an error message is displayed on the different docking station. The error message indicates that the temperature reading can only be displayed on the docking station from which the wireless thermometer probe was removed. In some examples, the error message also provides an identifier for the docking station from which the wireless thermometer probe was removed.

At operation 1010, when a determination is made that the wireless thermometer probe has not been returned to a different docking station, at operation 1014, the wireless thermometer probe may be connected to a client computer in an attempt to display the temperature reading. At operation 1014, when a determination is made that the wireless thermometer probe has been connected to a client computer, at operation 1012 an error message is displayed on the client computer. The error message indicates that the temperature reading can only be displayed on the docking station from which the wireless thermometer probe was removed. In some examples, the error message also provides an identifier for the docking station from which the wireless thermometer probe was removed.

Figure 11:
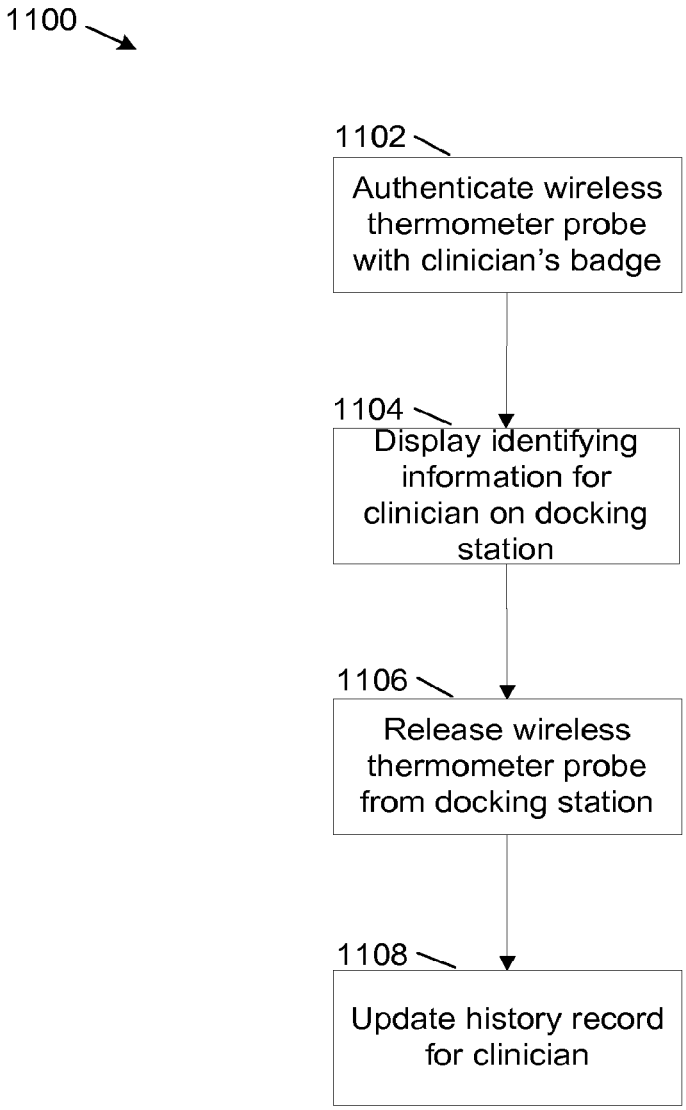
FIG. 11 shows an example flowchart for an authentication anti-loss mechanism.

FIG. 11 shows an example flowchart for a method 1100 for implementing authentication mechanism 206. For the example method 1100, a wireless thermometer probe is authenticated before the wireless thermometer probe may be released from a docking station. In some examples, another type of hand-held medical device, for example a wireless oxygen saturation sensor, may be used instead of the wireless thermometer probe.

At operation 1102, the wireless thermometer probe is authenticated with a clinician's badge. In some examples, authentication may comprise touching the wireless thermometer with the clinician's badge. In other examples, authentication may comprise having the clinician's badge touch or come in close contact with the docking station. In some examples, when the clinician's badge touches or comes into close contact with the docking station, the clinician is authenticated to the docking station and the first hand-held medical device removed from the docking station is authenticated to the clinician.

Other methods of authentication are possible. For example, in alternative embodiments, the clinician him or herself can be authenticated using other processes, such as biometrics.

At operation 1104, identification information for the clinician is displayed on docking station 104. The identification information may include the date, time, clinician's name, title, department and other similar information. In some examples, the identification information may include a photo of the physician. Other identification information is possible. In some examples, the identification information may also be stored on the docking station 104.

At operation 1106, the wireless thermometer probe is released from the docking station so that the clinician can remove the wireless thermometer probe from docking station 104. In the example method 1100, no hand-held medical device, including the wireless thermometer probe may be removed from docking station 104 without prior authentication.

At operation 1108, a history record is updated for the clinician. The history information may be an authentication history for the clinician, including such items as a record for each authentication for the clinician, names of the docking station at which the clinician is authenticated, identification of any hand-held medical equipment removed from each docking station by the clinician, etc.

Figure 12:
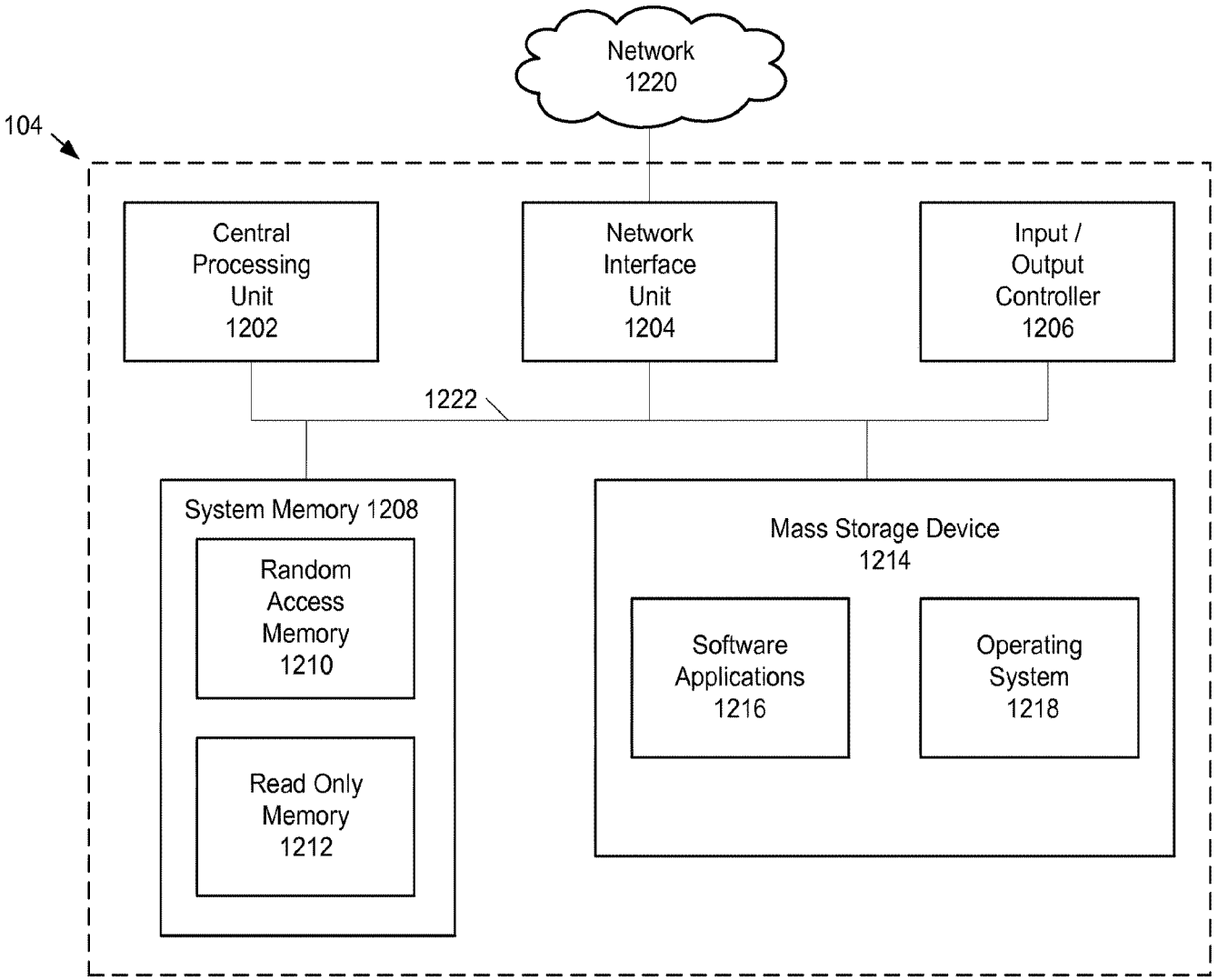
FIG. 12 shows example physical components of the docking station of FIG. 1.

FIG. 12 illustrates example physical components of the docking station 104. As illustrated in the example of FIG. 12, the docking station 104 includes at least one central processing unit ("CPU") 1202, a system memory 1208, and a system bus 1222 that couples the system memory 1208 to the CPU 1202. The system memory 1208 includes a random access memory ("RAM") 1210 and a read-only memory ("ROM") 1212. A basic input/output system contains the basic routines that help to transfer information between elements within the docking station 104, such as during startup, is stored in the ROM 1212. The docking station 104 further includes a mass storage device 1214. The mass storage device 1214 is able to store software instructions and data.

The mass storage device 1214 is connected to the CPU 1202 through a mass storage controller (not shown) connected to the bus 1222. The mass storage device 1214 and its associated computer-readable data storage media provide non-volatile, non-transitory storage for the docking station 104. Although the description of computer-readable data storage media contained herein refers to a mass storage device, such as a hard disk or solid state disk, it should be appreciated by those skilled in the art that computer-readable data storage media can be any available non-transitory, physical device or article of manufacture from which the central display station can read data and/or instructions.

Computer-readable data storage media include volatile and non-volatile, removable and non-removable media implemented in any method or technology for storage of information such as computer-readable software instructions, data structures, program modules or other data. Example types of computer-readable data storage media include, but are not limited to, RAM, ROM, EPROM, EEPROM, flash memory or other solid state memory technology, CD-ROMs, digital versatile discs ("DVDs"), other optical storage media, magnetic cassettes, magnetic tape, magnetic disk storage or other magnetic storage devices, or any other medium which can be used to store the desired information and which can be accessed by the docking station 104.

According to various embodiments of the invention, the docking station 104 may operate in a networked environment using logical connections to remote network devices through the network 1220, such as a local network, the Internet, or another type of network. The docking station 104 may connect to the network 1220 through a network interface unit 1204 connected to the bus 1222. It should be appreciated that the network interface unit 1204 may also be utilized to connect to other types of networks and remote computing systems. The docking station 104 also includes an input/output controller 1206 for receiving and processing input from a number of other devices, including a keyboard, a mouse, a touch user interface display screen, or another type of input device. Similarly, the input/output controller 1206 may provide output to a touch user interface display screen, a printer, or other type of output device.

As mentioned briefly above, the mass storage device 1214 and the RAM 1210 of the docking station 104 can store software instructions and data. The software instructions include an operating system 1218 suitable for controlling the operation of the docking station 104. The mass storage device 1214 and/or the RAM 1210 also store software instructions, that when executed by the CPU 1202, cause the docking station 104 to provide the functionality of the docking station 104 discussed in this document. For example, the mass storage device 1214 and/or the RAM 1210 can store software instructions that, when executed by the CPU 1202, cause the docking station 104 to display received physiological data on the display screen of the docking station 104.

The physical components shown in FIG. 12 may also apply to one or more handheld medical devices 102. For example, the physical components shown in FIG. 12 may also apply to a wireless thermometer probe, an oxygen saturation sensor, etc.

Although various embodiments are described herein, those of ordinary skill in the art will understand that many modifications may be made thereto within the scope of the present disclosure. Accordingly, it is not intended that the scope of the disclosure in any way be limited by the examples provided.

What is claimed is:

1. A wireless medical device, comprising:

a medical sensor, wherein the medical sensor is a wireless thermometer probe;

an operational state module configured to:

monitor and store a status of operational states of the wireless medical device;

determine when the wireless medical device is removed from the docking station;

determine when the wireless medical device is used to record a temperature measurement; and determine when the wireless medical device is returned to the docking station;

a communication module configured to:

communicate with a docking station; and determine a distance between the wireless medical device and the docking station;

a mating module configured to associate an identifier for the wireless medical device with an identifier for the docking station;

an alarm module configured to activate an alarm based on data obtained by at least one of: the operational state module, the communication module, and the mating module;

a display; and a display module configured to cause the display to provide the identifier for the wireless medical device.

2. The wireless medical device of claim 1, wherein the mating module is further configured to cause the display to provide the identifier for the docking station.

3. The wireless medical device of claim 1, wherein the operational state module is configured to monitor an amount of time the wireless medical device has been in an idle state; and wherein the alarm is activated when both: a predetermined period of time that the wireless medical device has been removed from the docking station exceeds a first threshold and a second predetermined period of time that the wireless medical device has been in the idle state exceeds a second threshold.

4. The wireless medical device of claim 3, wherein the idle state begins after the temperature measurement has been recorded.

5. The wireless medical device of claim 4, wherein the alarm is activated when a predetermined distance between the wireless medical device and a badge associated with a clinician exceeds a third threshold; and wherein the clinician is associated with the wireless medical device.

6. The wireless medical device of claim 4, further comprising a paging module configured to activate the alarm module when a paging button is selected on the docking station.

7. A method for providing an alarm for a wireless medical device, comprising:

monitoring a status of operational states of the wireless medical device;

storing the status of operational states of the wireless medical device;

associating an identifier for the wireless medical device with an identifier for a docking station;

displaying the identifier for the wireless medical device; and activating the alarm when the status of one of the operational states of the wireless medical device exceeds a threshold.

8. The method of claim 7, wherein the wireless medical device is configured to measure a temperature of a patient.

9. The method of claim 8, wherein the operational states of the wireless medical device include when the wireless medical device is removed from the docking station, when the wireless medical device is used to record a temperature measurement, and when the wireless medical device is returned to the docking station.

10. The method of claim 9, further comprising displaying the identifier for the wireless medical device and the identifier for the docking station on a display.

11. The method of claim 10, wherein the alarm is activated based upon at least one of: a time that the wireless medical device has been removed from the docking station, a first distance of the wireless medical device from the docking station, and a second distance of the wireless medical device from a clinician badge.

12. An electronic computing device, comprising:

a processing unit; and system memory, the system memory including instructions that, when executed by the processing unit, cause the electronic computing device to:

monitor and store a status of operational states of a wireless medical device, the wireless medical device being a thermometer probe;

communicate with a docking station;

associate an identifier for the wireless medical device with an identifier for the docking station;

determine when the wireless medical device is removed from the docking station;

determine when the wireless medical device is used to record a temperature measurement;

determine a distance between the wireless medical device and the docking station;

determine when the wireless medical device is returned to the docking station; and activate an alarm when an alarm based on at least one of: the distance between the wireless medical device and the docking station and when the wireless medical device is returned to the docking station.

13. The electronic computing device of claim 12, wherein the instructions further cause the electronic computing device to:

display the identifier for the wireless medical device; and display the identifier for the docking station.

14. The electronic computing device of claim 13, wherein the instructions further cause the electronic computing device to:

monitor an amount of time the wireless medical device has been in an idle state, wherein the idle state begins after the temperature measurement has been recorded;

activate the alarm if the amount of time the wireless medical device has been in the idle state exceeds a first predetermined threshold.

15. The electronic computing device of claim 14, wherein the alarm is activated when a predetermined distance between the wireless medical device and a clinician badge exceeds a second predetermined threshold;

wherein a clinician is associated with the wireless medical device; and wherein the clinician badge includes a photograph of the clinician.

16. The electronic computing device of claim 15, wherein the instructions further cause the electronic computing device to:

activate the alarm when a paging button is selected on the docking station.

* * * * *